US012195678B2

(12) United States Patent
Patel et al.

(10) Patent No.: US 12,195,678 B2
(45) Date of Patent: Jan. 14, 2025

(54) SYSTEMS FOR MODIFYING DESALTER ALKALINITY CAPACITY AND USES THEREOF

(71) Applicant: PHILLIPS 66 COMPANY, Houston, TX (US)

(72) Inventors: Amit B. Patel, Owasso, OK (US); Lyda Zambrano, Houston, TX (US); Varadharajan Kailasam, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 18/180,921

(22) Filed: Mar. 9, 2023

(65) Prior Publication Data

US 2023/0295520 A1 Sep. 21, 2023

Related U.S. Application Data

(60) Provisional application No. 63/320,413, filed on Mar. 16, 2022, provisional application No. 63/320,407, filed on Mar. 16, 2022.

(51) Int. Cl.
*C10G 33/04* (2006.01)
*C10G 33/08* (2006.01)

(52) U.S. Cl.
CPC ..... *C10G 33/04* (2013.01); *C10G 33/08* (2013.01)

(58) Field of Classification Search
CPC ..... C10G 33/04; C10G 33/08
See application file for complete search history.

(56) References Cited

U.S. PATENT DOCUMENTS

2012/0043256 A1* 2/2012 Kremer ..... C10G 33/04 516/190
2015/0152340 A1* 6/2015 Cherney ..... C10G 33/04 208/290
2015/0267127 A1* 9/2015 Yeganeh ..... C10G 31/08 204/567

* cited by examiner

*Primary Examiner* — Randy Boyer
*Assistant Examiner* — Juan C Valencia
(74) *Attorney, Agent, or Firm* — Phillips 66 Company

(57) ABSTRACT

A system comprising a pretreated hydrocarbon feedstock supply, wherein said pretreated hydrocarbon feedstock supply comprises at least hydrocarbon feedstock and dissolved salts; a wash water supply, wherein said wash water supply comprises at least water; an alkalinity modifier supply, wherein said alkalinity modifier supply comprises at least one alkalinity modifier or solutions thereof; a desalting vessel; a desalted crude outlet, wherein said desalted crude outlet comprises hydrocarbon feedstock with less dissolved salts by weight than the hydrocarbon feedstock in the pretreated hydrocarbon feedstock supply; and a wash water brine outlet, wherein said wash water brine outlet comprises water with more dissolved salts by weight than the water in the wash water supply.

9 Claims, 15 Drawing Sheets

Refinery wash water; Effluent pH = 4.3

Refinery wash water (with NaOH, pH 10); Effluent pH = 4.4

Refinery wash water (with NaOH, pH 11); Effluent pH = 4.7

Refinery wash water (with NaOH, pH 12); Effluent pH = 7.1

Refinery wash water; Effluent pH = 4.3

Refinery wash water (with DMEA = 43 ppm); Effluent pH = 4.6

Refinery wash water (with DMEA = 106 ppm); Effluent pH = 4.9

Refinery wash water (with DMEA = 212 ppm); Effluent pH = 5.5

Refinery wash water; Effluent pH = 4.3

Stripped sour water; Effluent pH = 5.5

Refinery wash water (with NaHCO3 = 300 ppm); Effluent pH ~ 6.9

Refinery wash water Effluent pH = 4.3

NaHCO3 = 300 ppm; Effluent pH ~ 6.9

NaHCO3 = 500 ppm; Effluent pH ~ 7.6

NaHCO3 = 700 ppm; Effluent pH ~ 7.8

No adjustment Effluent pH = 4.34 | KHCO3 300 ppm Effluent pH = 6.72 | KHCO3 600 ppm Effluent pH = 8.20 | KHCO3 950 ppm Effluent pH = 8.72

No adjustment No Emulsion Breaker; Effluent pH = 5.01 | KHCO3 300 ppm No Emulsion Breaker; Effluent pH = 7.42 | No adjustment 5 ppm, Emulsion Breaker; Effluent pH = 4.78 | KHCO3 300 ppm 5 ppm, Emulsion Breaker; Effluent pH = 7.55

SYSTEMS FOR MODIFYING DESALTER ALKALINITY CAPACITY AND USES THEREOF

CROSS-REFERENCE TO RELATED APPLICATIONS

This application is a non-provisional application which claims the benefit of and priority to U.S. Provisional Application Ser. No. 63/320,413 filed Mar. 16, 2022, entitled "Systems for Modifying Desalter Wash Water Alkalinity Capacity and Uses Thereof" and U.S. Provisional Application Ser. No. 63/320,407 filed Mar. 16, 2022, entitled "Methods for Modifying Desalter Wash Water Alkalinity Capacity and Uses Thereof" both of which are hereby incorporated by reference in its entirety.

STATEMENT REGARDING FEDERALLY SPONSORED RESEARCH OR DEVELOPMENT

None.

FIELD OF THE INVENTION

This invention relates to the modification of wash water alkalinity capacity for use in desalter units.

BACKGROUND OF THE INVENTION

Hydrocarbons often contains impurities which include water, salts in solution and solid particulate matter that may corrode and build up solid deposits in refinery units; these impurities must be removed before the hydrocarbons can be processed in a refinery. The impurities are removed from the hydrocarbons by a process known as "desalting", in which hot hydrocarbons are mixed with water and a suitable demulsifying agent to form a water-in-oil emulsion which provides intimate contact between the hydrocarbons and water so that the salts pass into solution in the water. The emulsion is then passed into a high voltage electrostatic field inside a closed separator vessel. The electrostatic field coalesces and breaks the emulsion into a hydrocarbon continuous phase and a water continuous phase. The hydrocarbon continuous phase rises to the top to form the upper layer in the desalter from where it is continuously drawn off while the water continuous phase (commonly called "brine") sinks to the bottom from where it is continuously removed. In addition, solids present in the crude will accumulate in the bottom of the desalter vessel. The desalter must be periodically jet washed to remove the accumulated solids such as clay, silt, sand, rust, and other debris by periodically recycling a portion of the desalter effluent water to agitate the accumulated solids so that they are washed out with the effluent water. These solids are then routed to the wastewater system. Similar equipment (or units) and procedures, except for the addition of water to the hydrocarbon, are used in hydrocarbon producing fields to dehydrate the hydrocarbon before it is transported to a refinery.

During operation of such units, an emulsion phase of variable composition and thickness forms at the interface of the hydrocarbon continuous phase and the water continuous phase in the unit. Certain crude oils contain natural surfactants in the crude oil (asphaltenes and resins) which tend to form a barrier around the water droplets in the emulsion, preventing coalescence and stabilizing the emulsion in the desalting vessel. Finely divided solid particles in the crude (<5 microns) may also act to stabilize the emulsion and it has been found that solids-stabilized emulsions present particular difficulties; clay fines such as those found in oils derived from oil sands are thought to be particularly effective in forming stable emulsions. This emulsion phase may become stable and persist in the desalting vessel. If this emulsion phase (commonly known as the "rag" layer) does stabilize and becomes too thick, the oil continuous phase will contain too much brine and the lower brine phase will contain unacceptable amounts of oil. In extreme cases it results in emulsion being withdrawn from the top or bottom of the unit. Oil entrainment in the water phase is a serious problem as it is environmentally impermissible and expensive to remedy outside the unit. Also, it is desirable to achieve maximum coalescence of any remaining oil droplets entrained in the water continuous phase and thereby ensure that the withdrawn water phase is substantially oil free by operating the unit with the water continuous phase to be as close as possible to the high voltage electrodes in the unit without resulting in shorting across the oil to the water. If, on the one hand, the emulsion phase gets too thick the dosage of the demulsifying agent must be increased; on the other hand, if the water continuous phase gets too high or too low, the water phase withdrawal valve at the bottom of the unit called a "dump valve" must be correspondingly opened or closed to the degree necessary to reposition the water phase to the desired level in the unit and for this purpose, it is necessary to monitor the level and condition of the phases in the unit.

Others have attempted to mitigate stable emulsions by introduction of steam, demulsifiers, amines, polymer emulsion breakers, caustic injections, silicon additives, and other components into various streams of the desalting process. Still, others have attempted to introduce components into the desalter vessels themselves. These efforts by others have proven costly and create need for sophisticated control systems. In particular, some of these attempted solutions require significant corrosion management both in the desalter and downstream. As a result, the addition of other components requires even further processing of the crude stream.

For example, U.S. Pat. No. 9,410,092 attempts to mitigate this problem by utilizing a centrifuge to reduce the rag layer. Alternatively, U.S. Pat. No. 9,611,433 attempts to mitigate this problem constant monitoring of the rag layer and constant adjustment of the water phase.

There exists a need to provide a low cost, simple operation of a desalter unit that is capable of handling acidic Crude Oil feeds without the need of complicated chemistry controls.

BRIEF SUMMARY OF THE DISCLOSURE

The present embodiment relates to a petroleum desalting system comprising a pretreated hydrocarbon feedstock supply, wherein said pretreated hydrocarbon feedstock supply comprises at least hydrocarbon feedstock and dissolved salts; a wash water supply, wherein said wash water supply comprises at least water; an alkalinity modifier supply, wherein said alkalinity modifier supply comprises at least one alkalinity modifier or solutions thereof; a desalting vessel; a desalted crude outlet, wherein said desalted crude outlet comprises hydrocarbon feedstock with less dissolved salts by weight than the hydrocarbon feedstock in the pretreated hydrocarbon feedstock supply; and a wash water brine outlet, wherein said wash water brine outlet comprises water with more dissolved salts by weight than the water in the wash water supply.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
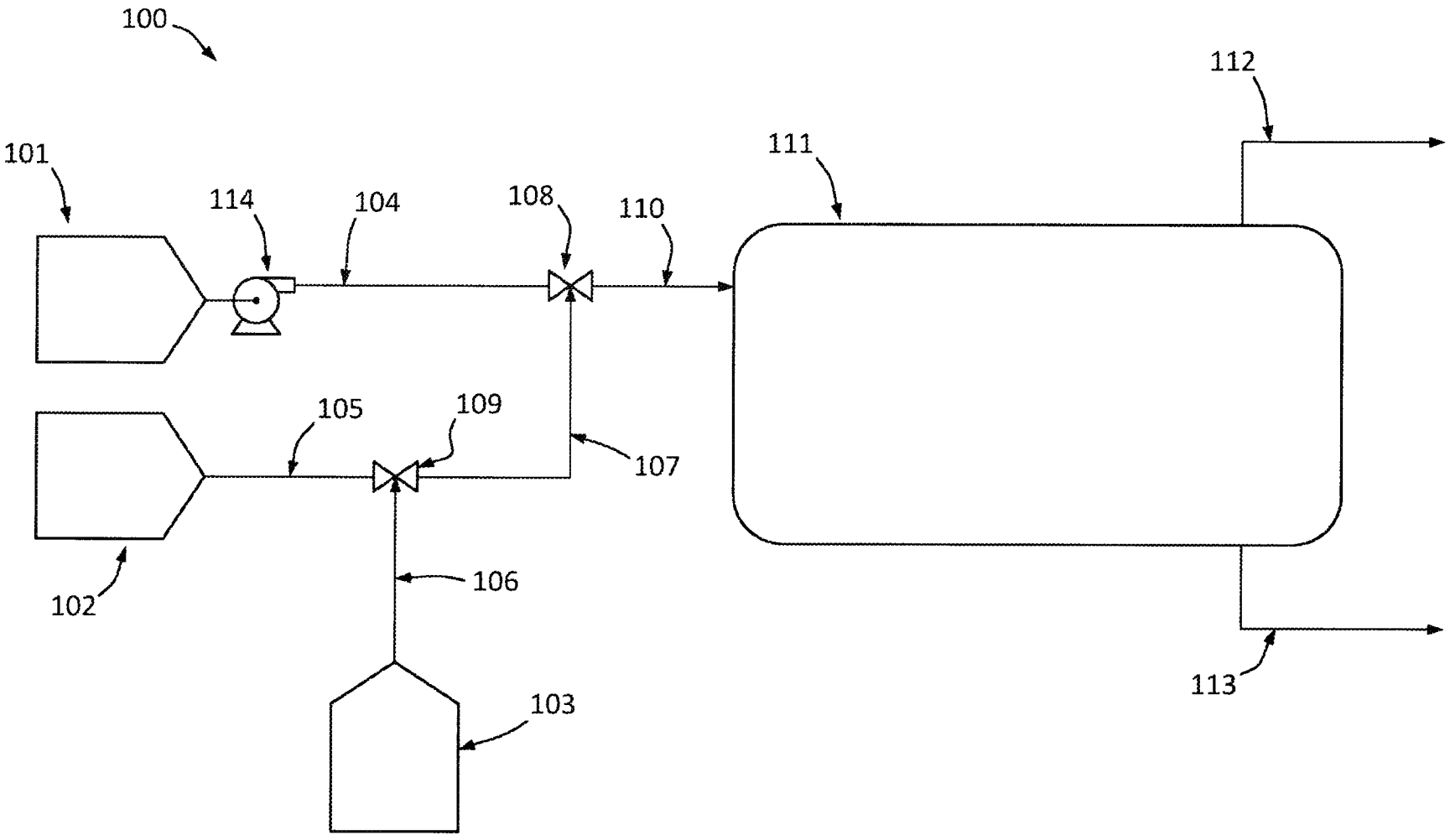
FIG. 1 depicts a flow diagram of an embodiment of a desalting process that implements introduction of an alkalinity modifier to a system

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Hydrocarbon feedstocks can broadly as those commonly known in the refinery industry. These feedstocks can include crude petroleum oil, triglyceride-based feeds, seed oils, tire (or tyre) oils, slop oil, biomass oils, nut oils, and blends thereof. Contaminants can also be present in the hydrocarbon feedstocks which can include salts, acids, amine, metals and other materials that may negatively impart refinery process units and piping.

Wash water can be from a variety of sources within a refinery. For example wash water can comprise of recycled refinery water, recirculated wastewater, clarified water, purified wastewater, sour water stripper bottoms, overhead condensate, boiler feed water, clarified river water, sea water or salt water, brine previously created from the desalting process, or from other water sources or combinations of water sources and blends thereof.

Crude petroleum typically contains salts and other contaminants that may corrode refinery units; salt and other contaminants are removed from the crude oil (petroleum) by a process known as "desalting," in which crude oil is mixed with water (wash water) to form a water-in-oil emulsion or mixture which provides intimate contact between the oil and water, transferring salt and contaminants into the water. The salty emulsion water (or droplets) then separates in a desalting vessel. During the separation process, the salty water settles to the bottom of the tank under gravitation. The desalted oil forms at the upper layer in the desalter from where it is continuously drawn off for distillation. The salty water is withdrawn from the bottom of the desalter.

Hydrocarbons or crude oils may contain many impurities that are detrimental to refinery operation and the refined products themselves. Some of these impurities, including various salts, are known to contribute to corrosion of refinery equipment, to decreased heat transfer efficiency due to fouling of heat exchangers, and to catalyst poisoning, among other undesirable conditions. Salt and other contaminants in the hydrocarbons may take the form of metallic salts, including metal halides such as magnesium chloride, sodium chloride, calcium chloride, and other salts known to those skilled in the art.

In some settings, the hydrocarbons and/or the wash water are heated prior to or following mixing. The heating can be independent of the refinery process or transferred from other processes in the refinery. In one embodiment, it is also ideal to heat the hydrocarbon and/or wash water to minimize thermal gradients.

In some settings, after the salty emulsion enters the desalting vessel, it is optionally passed into a high voltage electric field inside the closed separator vessel. In that instance, the electric field forces water droplets to coalesce, forming larger water droplets than without this modification. This electric field facilitates desalting but is not necessary.

In one embodiment, the hydrocarbon feedstock containing dissolved salts enters a desalter vessel as pre-treated crude. The pretreated crude is mixed with wash water containing an alkalinity modifier. That mixture is transferred to a desalting vessel where the dissolved salts are separated from the pretreated crude oil to create desalted crude oil. The separated salts are transferred to wash water wherein said water becomes a brine. The desalted crude oil and brine are then separately removed from the vessel. Notably, in some embodiments, some or all of the desalted crude oil may be recycled back into the process as pre-treated crude oil. In some embodiments, some or all of the brine may be recycled back into the process as wash water. Still, other embodiments, the process may feature recycle of both desalted crude and brine into pre-treated crude and wash water, respectively.

In one embodiment, desalting is performed in a batch manner. In another embodiment, desalting is performed as a continuous activity, which may or may not be slowed or shut down from time to time. In yet another embodiment, desalting is performed in a two- or multi-step format, where crude undergoes multiple stages of desalting, and multiple desalting units may be connected either serially or in parallel. This aspect of the invention can be described as multi-stage or cascade. Aspects of the invention may take place in the forms of systems, apparatuses, methods, processes and/or any other means known to those skilled in the art.

Feedstocks recovered from a subterranean formation generally are contaminated with those salts present in the formation brines or oil field brines. Examples of salts include magnesium chloride, calcium chloride, sodium chloride, calcium bromide, zinc bromide, magnesium sulfate, sodium sulfate, or combinations of any two or more thereof. It is well known that salts contribute to corrosion of refinery equipment such as the fractionators, to decreased heat transfer efficiency due to fouling of heat exchangers and coking of furnaces, and to catalyst poisoning.

Complex hydrocarbon feedstocks can contain strong acids likely used in upstream well acidization (e.g., HCl or other acids), and/or those from other natural and artificial sources. These complex crudes can cause episodes of low desalter pH when processing them.

Literature data shows acids stabilize petroleum crude oil emulsions when system pH is less than about 5.0. For example, the following papers have described this phenomenon, and are hereby incorporated by reference: S. Poteau, Jean-Francois Argillier, D. Langevin, F. Pincet, and E. Perez, Influence of pH on Stability and Dynamic Properties of Asphaltenes and Other Amphiphilic Molecules at the Oil-Water Interface, Energy Fuels, 2005, 19 (4); and Strassner, J. E., Effect of pH on Interfacial Films and Stability of Crude Oil-Water Emulsions. J Pet Technol 20, SPE-1939-PA, 1968. The stabilization of petroleum crude oil emulsions due to low pH within the desalter is not ideal. As discussed above, others have attempted to modify pH by virtue of addition of heavy acids and bases, which has created subsequent troubleshooting and resultant problems.

It has been discovered, as described herein, that modification of the alkalinity (buffer capability)—that is the desalter wash water's ability to resist change in pH (as opposed to targeted modification of pH alone), advantageously allows the desalter to process acidic and complex crudes without significant addition of other components to the wash water stream or reservoir within the desalter unit itself. In particular, the addition of an alkalinity modifier to desalter wash water reduces the need for a complex solution of additions, stabilizes the pH of the solution to increase the desalting capability of the unit, reduces stable and hard-to-break emulsions, and mitigates the concern for corrosion in the desalting unit and downstream.

It has been discovered that direct modification to the alkalinity (capability to buffer pH) to the wash water provides resilience of the desalter unit towards complex hydrocarbon feedstock, particularly those that are acidic in pH. Total alkalinity for a system represents the acid neutralizing capacity of a solution, and it is an indirect measure of a solution's buffering capacity. Water constituents contributing to total alkalinity can come from different sources that contain hydroxide, carbonate, bicarbonate, phosphate, acetate, citrate, and sulfate. The most common contributors of alkalinity are hydroxide ($OH^-$), bicarbonate ($HCO_3^-$), and carbonate ($CO_3^{2-}$). The proportion of different species contributing towards total alkalinity varies as a function of pH.

Suitable alkalinity modifiers (also known as buffer modifiers or buffer capacity modifiers) include, but are not limited to, sodium carbonate ($Na_2CO_3$), sodium bicarbonate ($NaHCO_3$), potassium bicarbonate ($KHCO_3$), potassium carbonate ($K_2CO_3$), ammonium carbonate ($(NH_4)_2CO_3$), ammonium bicarbonate ($(NH_4)HCO_3$), sodium acetate ($CH_3CO_2Na$), potassium acetate ($CH_3CO_2K$), sodium citrate ($C_6H_5O_7Na_3$), potassium citrate ($C_6H_5O_7K_3$), and other compositions that include bicarbonate ($HCO^{3-}$) anions, other compositions that include carbonate ($CO_3^{2-}$), and other compositions that would be known to those skilled in the art to increase alkalinity of aqueous solutions, and combinations of the aforementioned modifiers. In one embodiment, the use of potassium bicarbonate as an alkalinity modifier may be preferable to others, including sodium bicarbonate, due to its higher solubility limits in water at some conditions.

As addressed herein, concentration of the alkalinity modifier may be provided in parts per million (ppm) of equivalent calcium carbonate ($CaCO_3$) unless expressly designated differently (for example, "by mass"). Units of mg/L are a mass dissolved in a liquid. Likewise, units of ppm describe mass dissolved in liquid. Reporting alkalinity as "mg/L as $CaCO_3$" or "ppm as $CaCO_3$" specifies that the sample has an alkalinity equal to that of a solution with a certain amount of calcium carbonate ($CaCO_3$) dissolved in water. The actual units for the alkalinity titration are moles or equivalents per volume (moles/L or eq/L). Converting alkalinity from raw mass to "mg/L as $CaCO_3$" or "ppm as $CaCO_3$" takes into account that one mole of carbonate ($CO_3^{2-}$) can neutralize 2 moles of acid (W). The units of "mg/L as $CaCO_3$" or "ppm as $CaCO_3$" are for convenience only, allowing one skilled in the art to consider how much $CaCO_3$ would be needed to create a solution with the same alkalinity as a given sample. One skilled in the art would be able to determine sufficient quantities of alkalinity modifier according to the desired outcome, and further, one skilled in the art would be able to convert concentration units (i.e., ppm as $CaCO_3$ to mg/L, etc.) as the case may need.

In one embodiment, it has been found that wash water having about 100 ppm to about 950 ppm (by equivalent of $CaCO_3$) alkalinity modifier, and preferentially that amount of sodium bicarbonate, has a positive effect on the desalter's ability to handle acidic crude, mitigate stable emulsions, and maintain desirable pH conditions. In another embodiment, it has been found that wash water having about 100 ppm to about 950 ppm (by equivalent of $CaCO_3$) alkalinity modifier, and preferentially that amount of potassium bicarbonate, has a positive effect on the desalter's ability to handle acidic crude, mitigate stable emulsions, and maintain desirable pH conditions. The overall concentration of alkalinity modifier in the wash water, however, may be increased, decreased, or otherwise moderated based on desirable conditions and incoming crude feedstocks. One skilled in the art would be able to select the alkalinity modifier from any array of suitable options described herein and add said modifier in desirable concentrations to wash water based on availability, crude characteristics, and other concerns.

In one embodiment, a brine pH of at least about 5.0 is desirable to be maintained within the exit stream (brine stream) of the desalter. In one embodiment, a pH of at least about 5.5 is desirable to be maintained within the exit stream (brine stream) of the desalter. In another embodiment, a pH between about 5 and about 10 is desirable to be maintained within the exit stream (brine stream) of the desalter. In another embodiment, a pH between about 6 and about 8 is desirable to be maintained within the exit stream (brine stream) of the desalter.

In some embodiments, wash water may be derived from various sources and the water itself may be, for example, recycled refinery water, recirculated wastewater, clarified water, purified wastewater, sour water stripper bottoms, overhead condensate, boiler feed water, clarified river water, sea water or salt water, brine previously created from the desalting process, or from other water sources or combinations of water sources. Salts in water are measured in parts per thousand by weight (ppt) and could range from fresh water (<0.5 ppt), brackish water (0.5-30 ppt), saline water (30-50 ppt) to brine (over 50 ppt). Although raw water varying in hardness levels (such as deionized water, city water or soft water) may be used to favor exchange of salt from the crude into the aqueous solution, de-ionized water and/or soft water is not normally required to desalt Crude Oil feedstocks by themselves, although it may be mixed with recirculated water from the desalter to achieve a specific ionic content in either the water before emulsification or to achieve a specific ionic strength in the final emulsified product. One skilled in the art would know of other sources of wash water for the systems and processes described herein.

The use of the alkalinity modifier in the desalter wash water is without prejudice to the use of the demulsifiers commonly used in the processing of petroleum crude oil. Among the demulsifiers which may be used are those typically based on the following chemistries: polyethyleneimines, polyamines, polyols, ethoxylated alcohol sulfates, long chain alcohol ethoxylates, long chain alkyl sulfate salts, e.g. sodium salts of lauryl sulfates, epoxies, di-epoxides (which may be ethoxylated and/or propoxylated). A useful class of polyamines comprises the succinated polyamines prepared by the succination of polyamines/polyamine/imines with a long chain alkyl substituted maleic anhydride.

Likewise, the use of the alkalinity modifier is also without prejudice to emulsion breakers, wetting agents, reverse emulsion breakers, amines, inhibitors including other additives commercially available from chemical suppliers.

The degree of performance of the desalting process may be defined by one or more metrics, including water dehydration (also described as fraction of water separated) and/or final salt composition of desalted crude. These metrics—and by extension the degree of desalting performance—are a function of, but not limited to, the following non-exhaustive list of characteristics of the system and/or process: type of wash water or volume, Crude Oil quality, alkalinity modifier, amount of alkalinity modifier, desalter temperature, emulsion breaker chemistry, and other variables known to those having skill in the art. Additionally, these metrics are also a function of desalter system hardware than can include electric field, desalting vessel size and configuration, and mix energy. In one embodiment, the percentage of water dehydration is measured in terms of fraction of water separated from the crude oil and wash water mix. The fraction of water separated is determined by comparing the volume of water recovered versus the initial volume of water added to the system. In one embodiment, the fraction of water separated could be between 90% and about a 100%, though such performance could vary based on type of alkalinity modifier, amount of alkalinity modifier, temperature of the system, and other variables discussed herein and known to those having skill in the art. Still, in another embodiment, the fraction of water separated could be between 70% and about a 100%, though such performance could vary based on type of alkalinity modifier, amount of alkalinity modifier, temperature of the system, and other variables discussed herein and known to those having skill in the art. Likewise, in one embodiment the final salt composition of the desalted crude is measured as chlorides ppm. In one embodiment, the salt composition of the desalted crude is less than 10 ppm by weight. In another embodiment, the salt composition of the desalted crude is less than 8 ppm by weight. In yet another embodiment, the salt composition of the desalted crude is less than 6 ppm by weight.

The Figures discussed herein depict aspects of the invention by means of systems, apparatuses, methods, processes and/or any other means known to those skilled in the art.

FIG. 1 depicts an embodiment 100 for desalting oil featuring addition of an alkalinity modifier. A source of petroleum crude 101 is delivered to the system via inlet supply 104. A source of wash water 102 is delivered to the system via inlet supply 105. A source of alkalinity modifier 103 is delivered to the system via inlet supply 106. The wash water from inlet supply 105 may be mixed with the alkalinity modifier from inlet supply 106 by virtue of valve 109. The mixture of wash water and alkalinity modifier may be flowed through supply 107 to valve 108. Valve 108 may regulate the addition of wash water and alkalinity modifier solution to the petroleum crude supply. Following their mixture, the wash water, alkalinity modifier, and petroleum crude are introduced to the desalting vessel 111 via supply 110. The wash water with alkalinity modifier then separates salts from the petroleum crude within desalting vessel 111. Following the desalting process, a composition consisting of desalted crude oil leaves the vessel 111 via outlet line 112. Likewise, following the desalting process, a composition consisting of water with dissolved salts (brine) leaves the vessel 111 via outlet line 113. Optionally, pump 114 supplies the Crude Oil to the process is described here. In this and other embodiments, one skilled in the art may also include optional control units (not shown) within the system to regulate the rates at which the crude, wash water, and alkalinity modifiers are introduced into the system.

Figure 2:
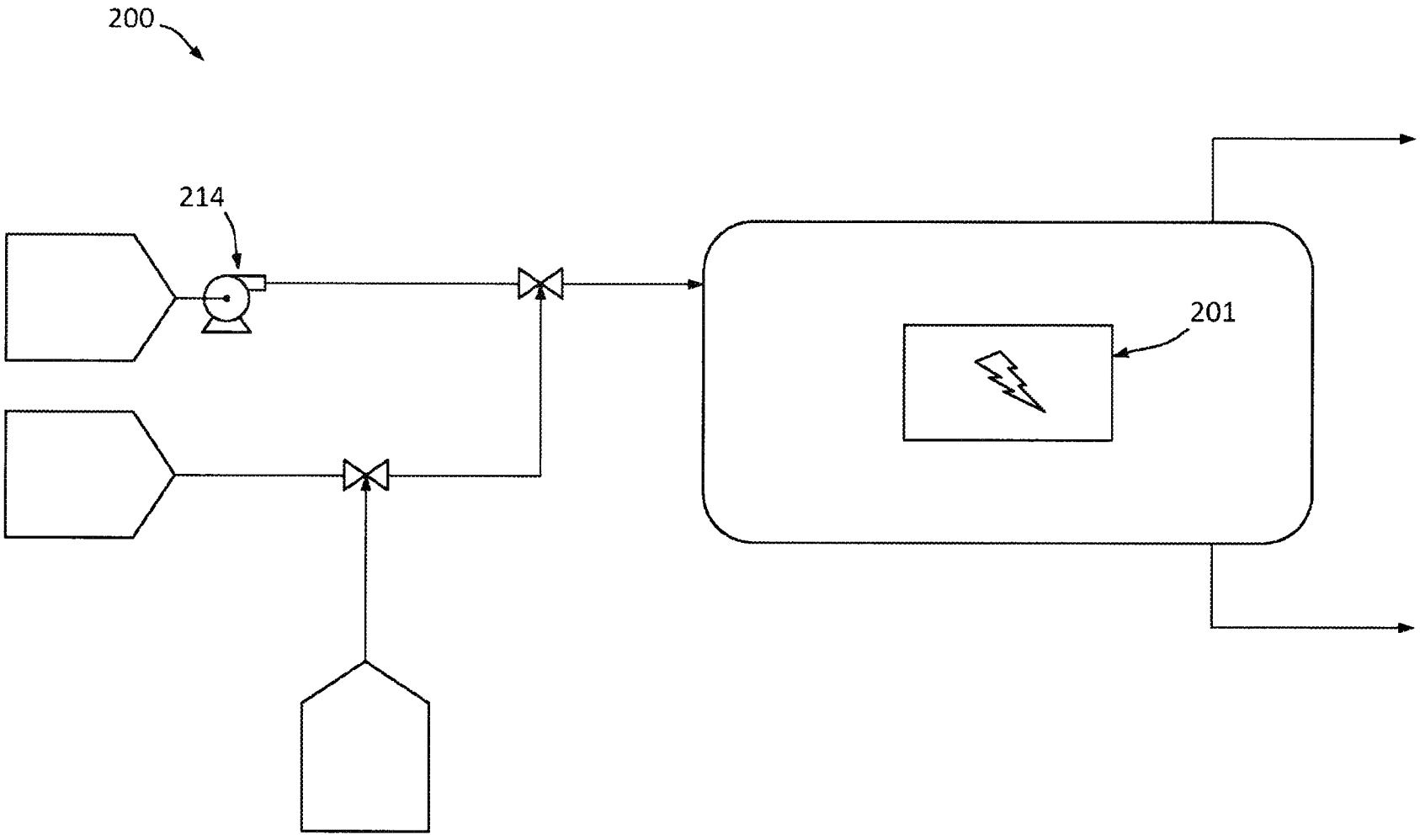
FIG. 2 depicts an alternative flow diagram of an embodiment of a desalting process that implements introduction of an alkalinity modifier to a system

FIG. 2 depicts an embodiment 200 for desalting oil featuring addition of an alkalinity modifier. In this embodiment, the same embodiment as 100 may be employed, though with the addition of an optional electric field 201 within the vessel 111. Optionally, pump 214 supplies the Crude Oil to the process is described here. Here, the mixture of oil and water may be optionally passed into a high voltage electric field inside a closed separator vessel. In that instance, the electric field forces water droplets to coalesce, forming larger water droplets than without this modification. In this embodiment, the electric field facilitates desalting, but is not necessary.

Figure 3:
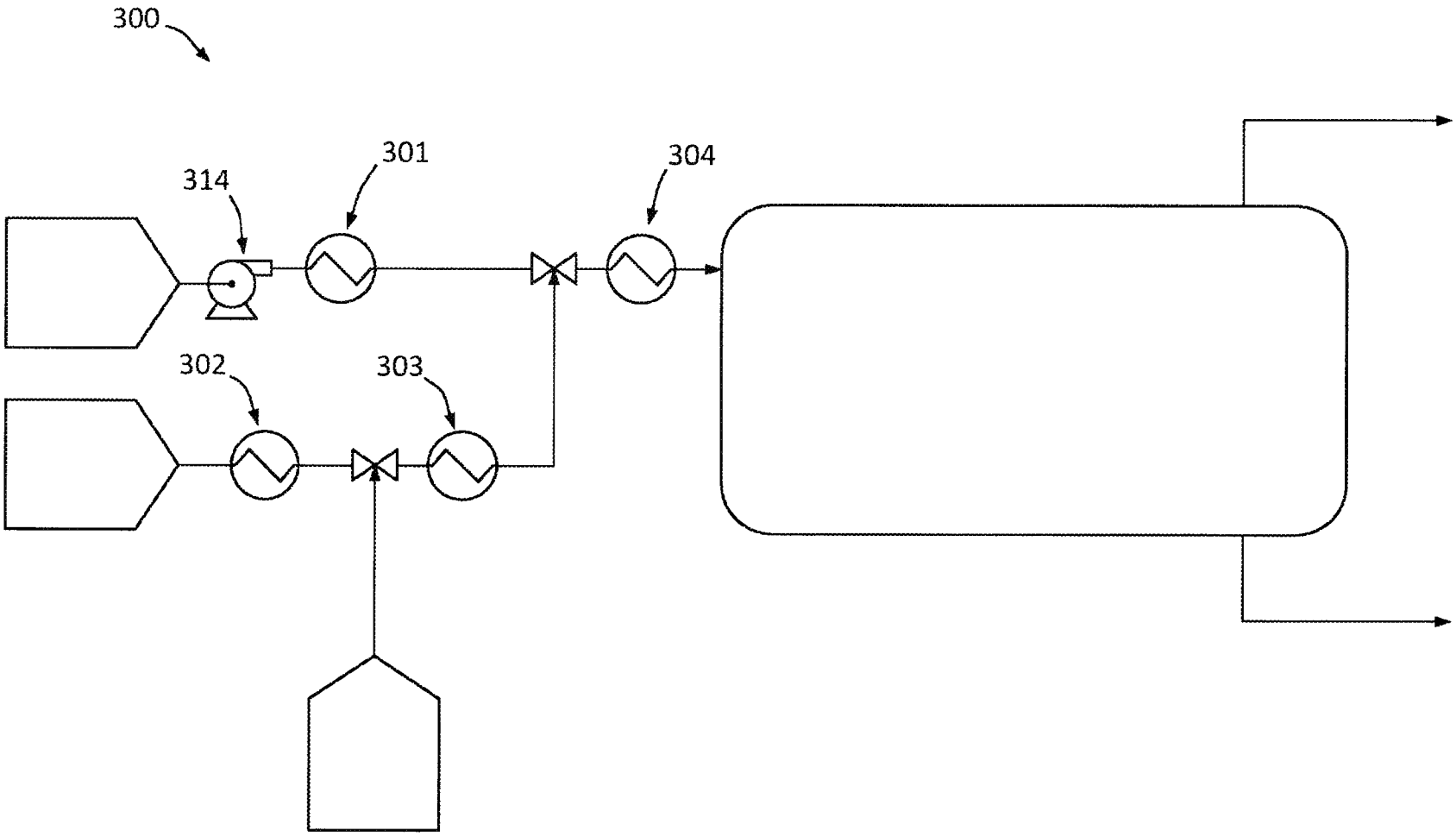
FIG. 3 depicts an alternative flow diagram of an embodiment of a desalting process that implements introduction of an alkalinity modifier to a system

FIG. 3 depicts an embodiment 300 for desalting oil featuring addition of an alkalinity modifier. In this embodiment, the same embodiment as 100 may be employed, though with the addition of optional heat exchangers 301, 302, 303, and 304. Optionally, pump 314 supplies the Crude Oil to the process is described here. Here, each heat exchanger is optional, and any combination of these may be used. The heat exchangers preheat the fluids in lines 104, 105, 107, and 110, respectively, to facilitate desalting. In another embodiment (not shown), heat exchangers may be added anywhere into the systems depicted by FIGS. 1-3. One skilled in the art would know how to implement and operate these heat exchangers.

While certain embodiments may be described in FIGS. 1-3, in other embodiments, the alkalinity modifier may be introduced into the crude oil inlet supply 104 in FIG. 1 as opposed to the wash water inlet supply (not shown). Additionally, the alkalinity modifier may be introduced before or after any of the pumps present in FIG. 1.

While certain embodiments may be described in FIGS. 1-3, in other embodiments, the alkalinity modifier may be introduced into the supply 110 in FIG. 1 (which contains oil and water) as opposed to the wash water inlet supply 105. Additionally, the source of the wash water 102 could also be modified upstream prior to the inlet supply 105.

Multiple desalting units or embodiments such as those depicted in FIGS. 1-3 may be connected together in series or in parallel and may form cascade or multi-stage operations. Similar type of vessel can also be utilized downstream of the crude oil distillation units, for example FCC and potentially other downstream units.

The following examples of certain embodiments of the invention are given. Each example is provided by way of explanation of the invention, one of many embodiments of the invention, and the following examples should not be read to limit, or define, the scope of the invention.

Concentration of the alkalinity modifier used in Examples 1-5 is expressed in parts per million (ppm) of equivalent calcium carbonate ($CaCO_3$) unless otherwise noted.

Example 1

Crude A (as a reference feedstock) and Crude B (which is an acidic crude feedstock) were used to study the emulsion behavior and effluent pH of solutions when subjected to water of varying quality. Static dehydration and emulsion resolution tests were performed using an Interav Model EDPT-228 Portable Electrostatic Dehydrator (PED). Crude oil and wash water (as optionally modified or sourced by the variations described herein) were poured and blended using Chandler Blender cups, then put into a 90° C. water bath for 20-30 minutes to allow the mixture to equilibrate to the test temperature. Cups were removed from the bath one at a time and blended at a pre-determined blend condition. The crude and water blends were then poured into preheated PED tubes and placed in the PED heater block, which was set at 90° C. Once all the PED tubes were filled, 500 volts were applied to each tube to promote water droplet coalescence.

| PED run conditions | |
|---|---|
| Blender speed | Crude B (3000 rpm); Crude A (4000 rpm) |
| Blending time | 8 s |
| Temperature | 90° C. |
| Voltage | 500 V |
| Wash water | 8% (vol) |
| Duration of run | 60 min |

The water separated from the PED was measured visually versus time for all tests. Pictures of the PED tubes were taken at 30 mins. After the PED tests were completed, the PED tubes were centrifuged for 20 minutes at 1500 RPM and the separated water was measured; this provided an estimate of the maximum possible water separation. The following tests were also performed on the separated oil and effluent water phases: 1) Water=Separated water pH and 2) Top oil (desalted crude)=Salt and water (Karl Fisher) of separated oil. The separated water pH is measured after allowing cooling of effluent water that separated out.

Figure 4A:
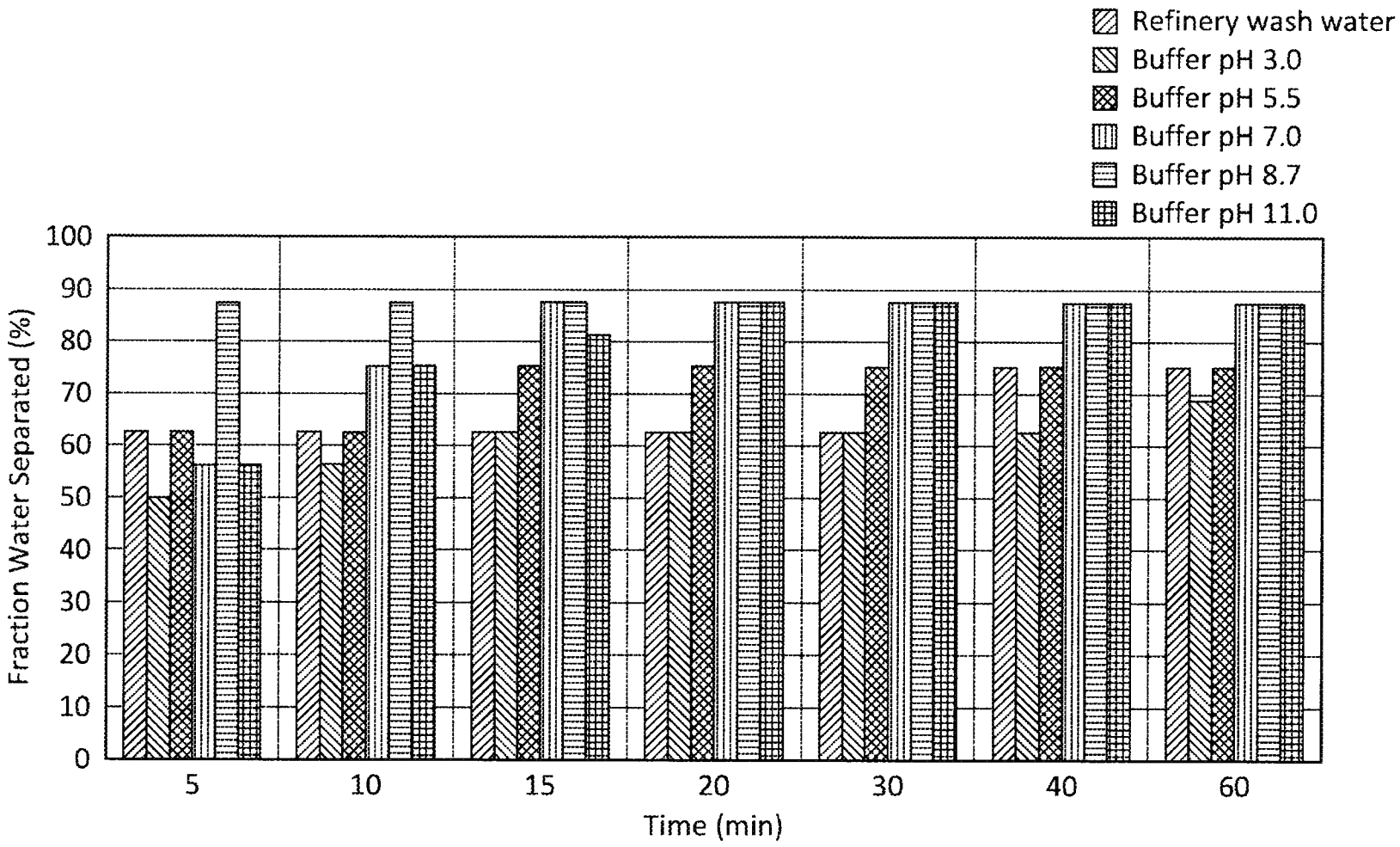
FIG. 4*a* depicts the effect of pH on the fraction water separated and visual effluent quality of Crude A oil mixed with both refinery wash water and pH buffered water.
Figure 4B:
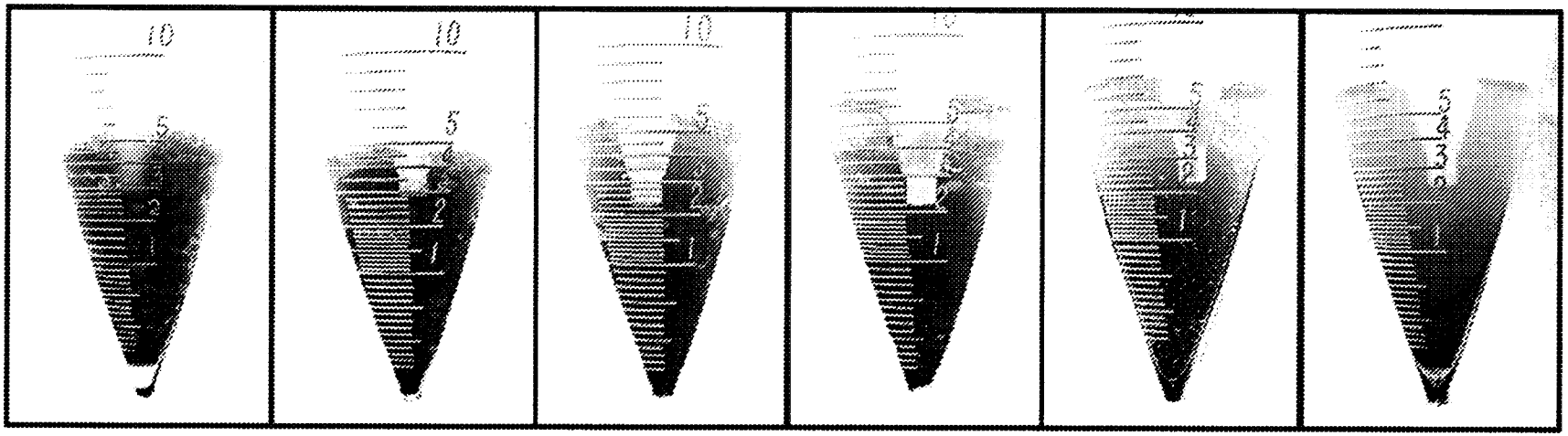
FIG. 4*b* depicts the effect of pH on the fraction water separated and visual effluent quality of Crude A oil mixed with both refinery wash water and pH buffered water.
Figure 5A:
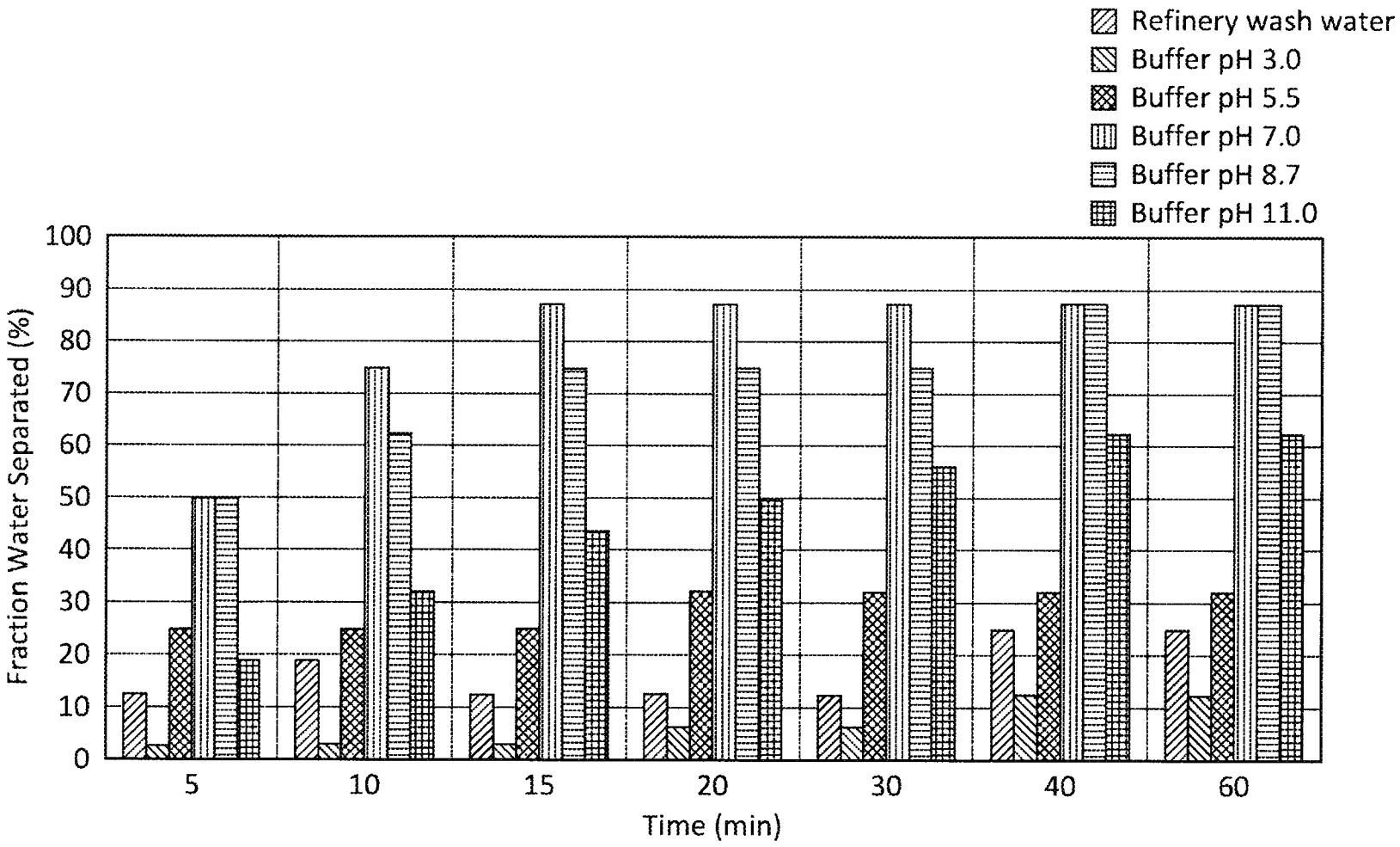
FIG. 5*a* depicts the effect of pH on the fraction water separated and visual effluent quality of Crude B oil mixed with both refinery wash water and pH buffered water.
Figure 5B:
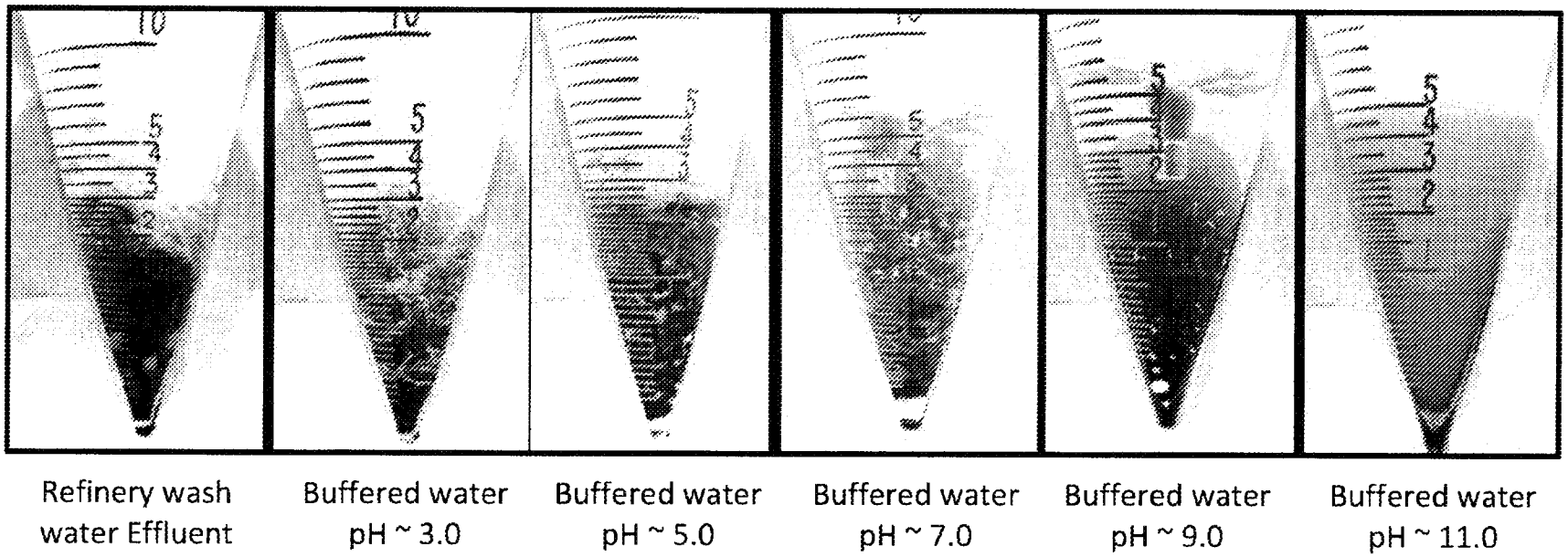
FIG. 5*b* depicts the effect of pH on the fraction water separated and visual effluent quality of Crude B oil mixed with both refinery wash water and pH buffered water

FIGS. 4*b* and 5*b* show the crude oil emulsion generated with Crude A (results depicted in FIG. 4*a*) and Crude B (results depicted in FIG. 5*a*) with buffered waters (pH of 3, 5, 7, 9, and 11). The buffered water at pH of 3 results in lower water separation for both Crude A and Crude B. Both cases exhibit a rag layer, which will increase the risk for a water carryover event in the desalter leading to an increased risk for overhead corrosion. Highest water separation is seen for separated water with pH of 7 and 9, with higher pH giving lower separation and much dirtier water, especially with Crude B oil. The asphaltene content of Crude A and Crude B crude oils used in this example were about 0.50%. Asphaltenes are reactive with both acids and bases. It is theorized that, in a low pH "acidic" environment the asphaltene will become protonated, and in a high pH "basic" environment asphaltenes become de-protonated. These changes increase the hydrophilic behavior of the asphaltene making them more polar thus allowing them to readily accumulate at the oil-water interface). The results in FIGS. 4*b* and 5*b* show more stable emulsions at low and high pH, respectively (i.e., not near neutral pH). This work shows desalter pH that results in manageable emulsion is between 7 and 9. If the desalter experiences excursion of tramp amines, then operating the desalter at target pH range 5.5 to 6.5 is preferred. Lower pH favors amine partitioning that minimizes amine carryover reducing the overhead corrosion risk.

Example 2

Example 2 was prepared in the same fashion as Example 1.

Figure 6A:
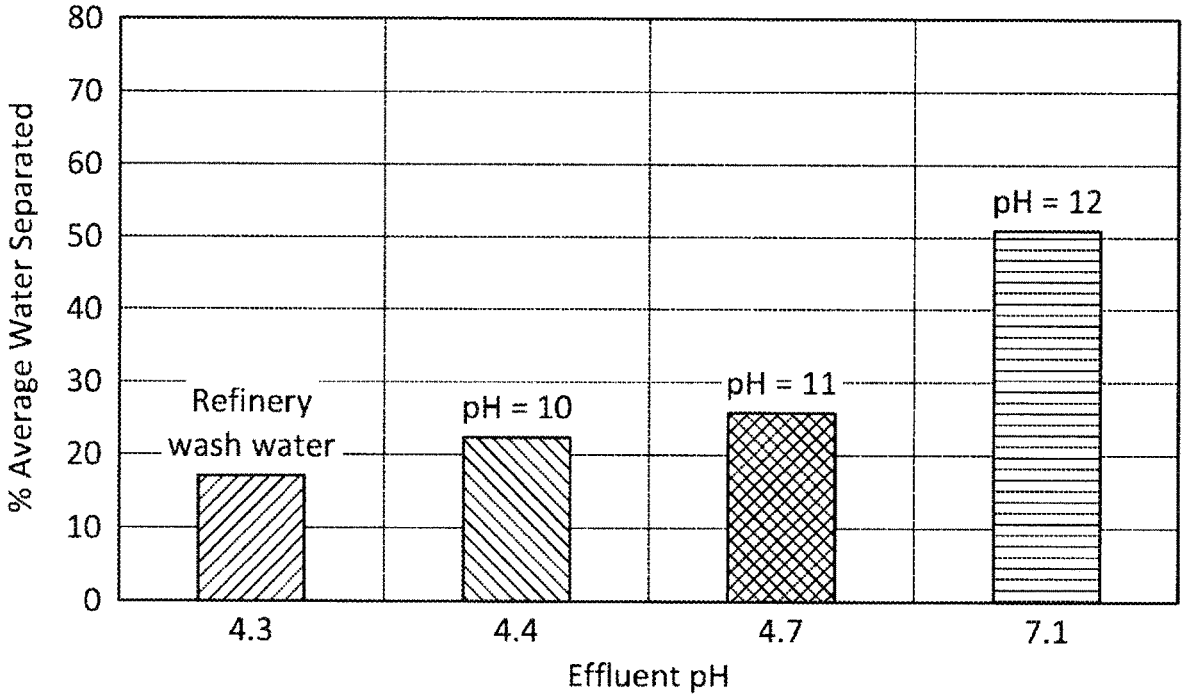
FIG. 6*a* depicts the effect of modifying wash water pH with NaOH to change water separation and effluent pH of Crude B.
Figure 6B:
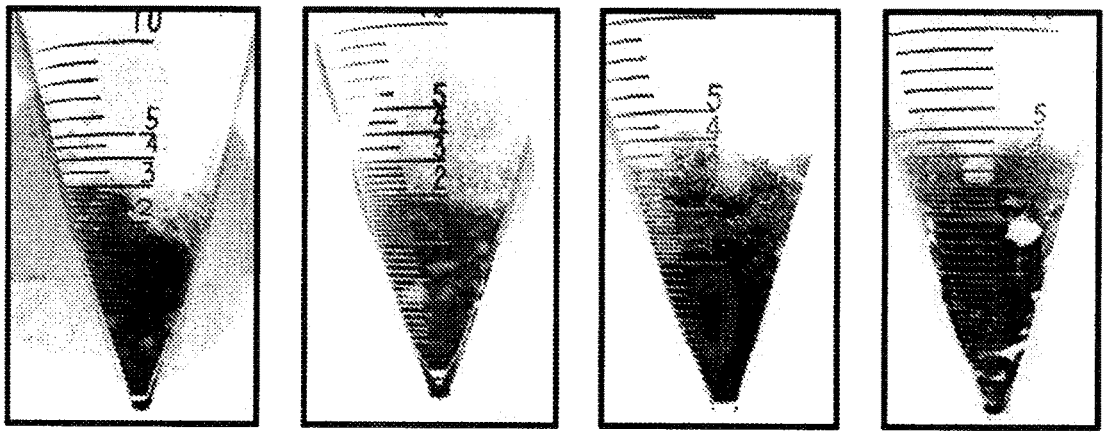
FIG. 6*b* depicts the effect of modifying wash water pH with NaOH to change water separation and effluent pH of Crude B.

As described by others, refinery wash water could be modified by addition of neutralizing amine (e.g. dimethylethanolamine (DMEA)) in the process, if needed. FIG. 6*a* and FIG. 6*b* shows the effect of adding caustic to create a high pH desalter wash water source (pH 10 to 12). The resulting effluent pH with these caustic treated waters with Crude B crude oil was observed to be 4.4, 4.7 and 7.1, respectively. High caustic dosage (pH 12) results in an effluent pH of 7.1 and fair water separation. Importantly, high pH water wash creates its own concerns for corrosion throughout the system including increased scaling potential.

Figure 7A:
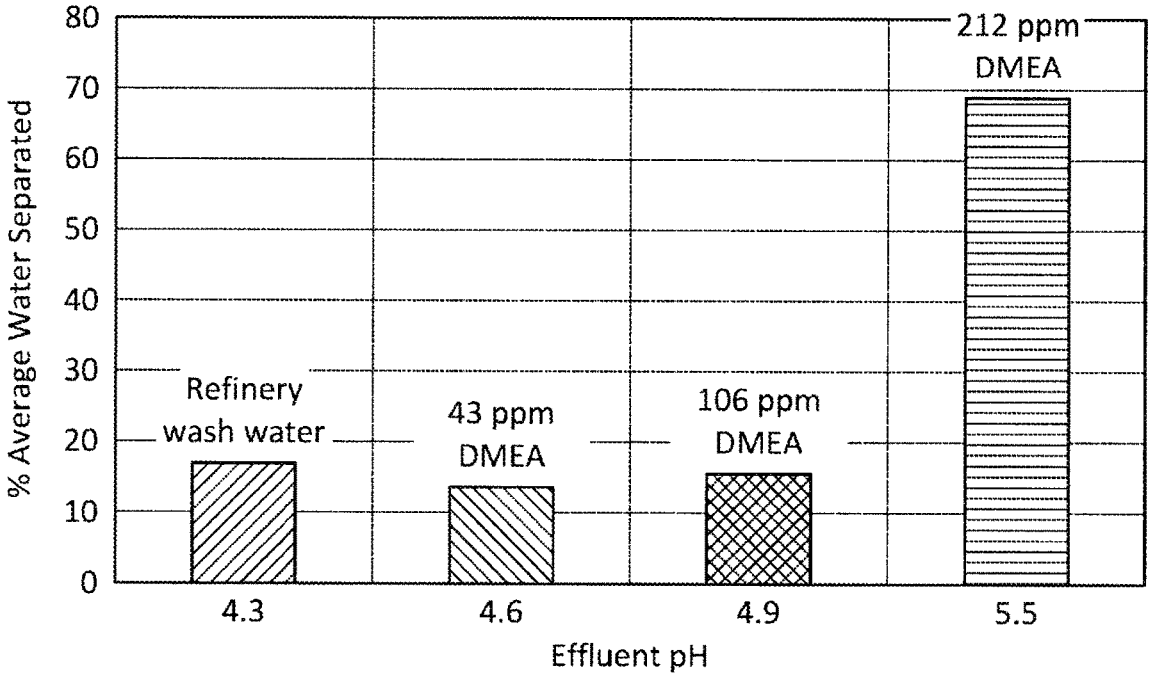
FIG. 7*a* depicts the effect of modifying wash water pH with addition of DMEA neutralizer amine to change water separation and effluent pH of Crude B.
Figure 7B:
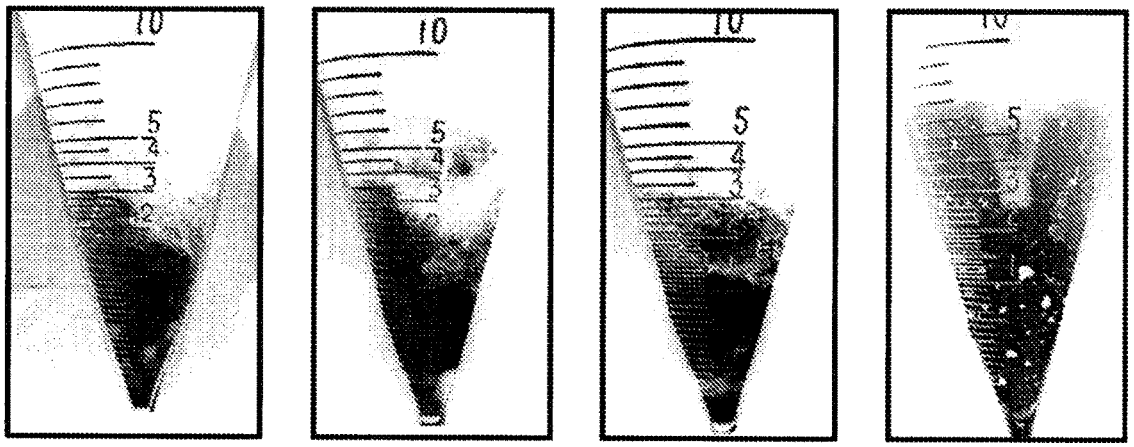
FIG. 7*b* depicts the effect of modifying wash water pH with addition of DMEA neutralizer amine to change water separation and effluent pH of Crude B.

As described by others, the refinery wash water could be modified by addition of caustic (NaOH) in the process, if desired. FIG. 7*a* and FIG. 7*b* show the effect of adding a neutralizing amine to create a higher pH desalter wash water source (pH 9.9 to 10.1). The resulting effluent pH with neutralizer amine was observed to be 4.6, 4.9, and 5.5. High neutralizing amine dosage yields a manageable effluent pH 5.5 and suitable water separation. Importantly, introduction of amine to water wash can create its own concerns for corrosion throughout the system including increased downstream fouling and corrosion potential from amine carryover to downstream process. Wastewater plant can also see impacts from increased nitrogen loading from use of amine-based additives in the desalter.

That said, both of these methods have proven to be non-ideal. In addition to being costly, both these water treatment options will significantly raise the pH of the refinery wash water resulting in carbonate scaling risk of the desalter wash water piping. In addition, the high dosage of the neutralizing amine will increase amine partitioning in the desalted crude oil and pose a corrosion risk for the tower that will require detailed review. The use of caustic or neutralizing amine for processing acidic crudes can have significant risks, and therefore, is not ideal for managing desalter reliability.

Example 3

Example 3 was prepared in the same fashion as Example 1.

Figure 8A:
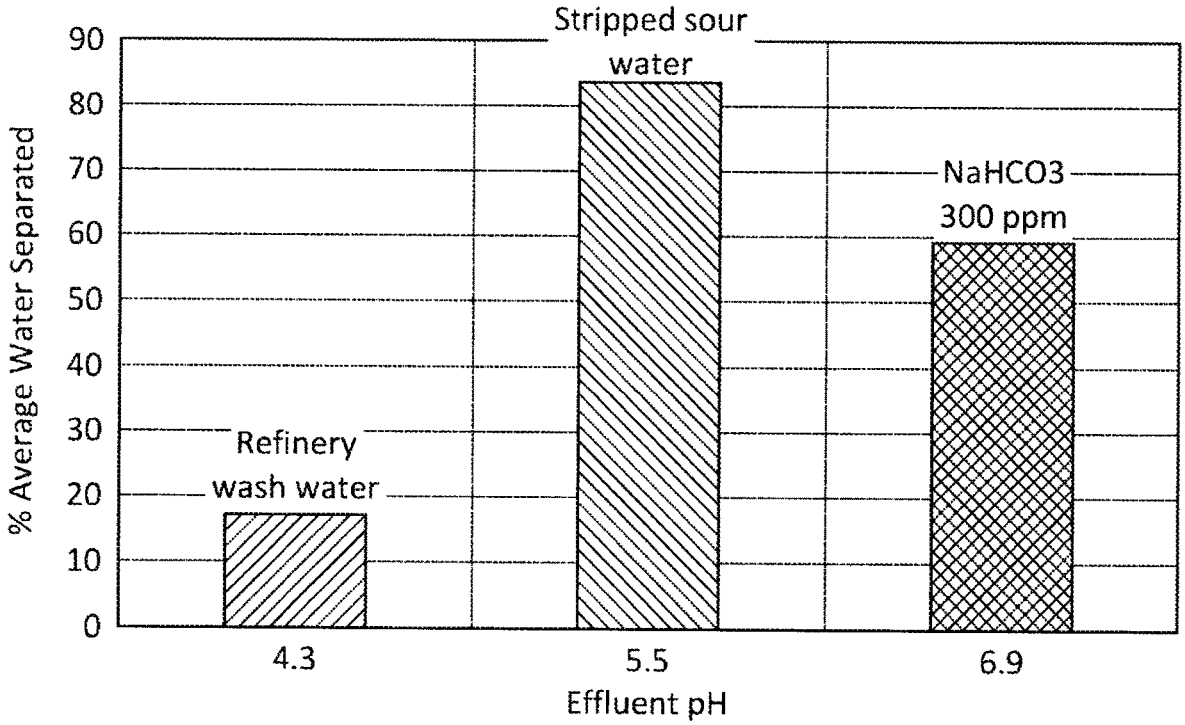
FIG. 8*a* depicts the effect of using refinery stripped sour water to change effluent pH and emulsion of Crude B.
Figure 8B:
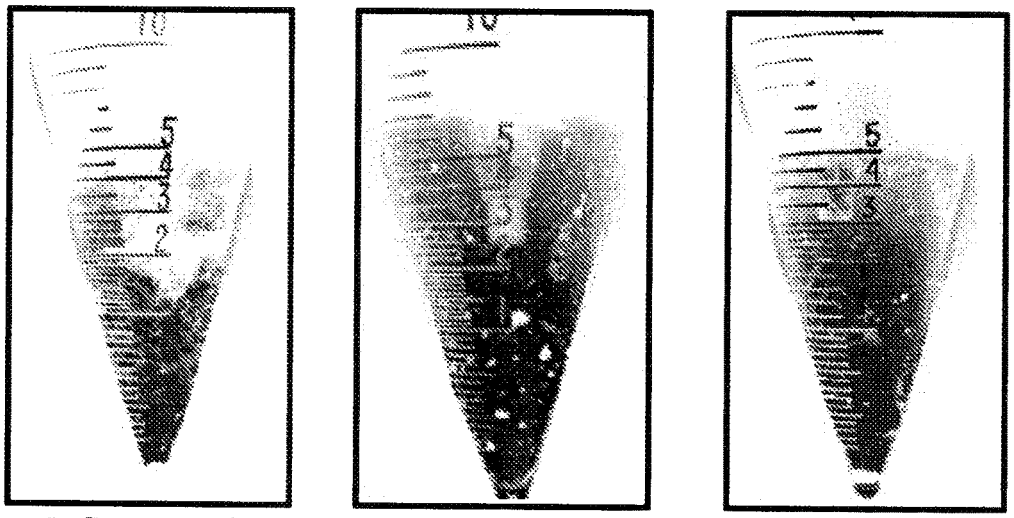
FIG. 8*b* depicts the effect of using refinery stripped sour water to change effluent pH and emulsion of Crude B.

Stripped sour water is a very common water source for desalting. In this Example, stripped sour water was used as wash water. The total alkalinity is about 330 ppm (as $CaCO_3$ ppm) and pH are about 6.6. FIG. 8*a* and FIG. 8*b* show significantly higher water separation using a stripped sour water source compared to raw and modified refinery wash water. The lab effluent pH using the stripped sour water source is about 5.5. While effective, this process resulted in lower brine effluent pH, which is not desirable from a corrosion science standpoint.

Example 4

Example 4 was prepared in the same fashion as Example 1.

Figure 9A:
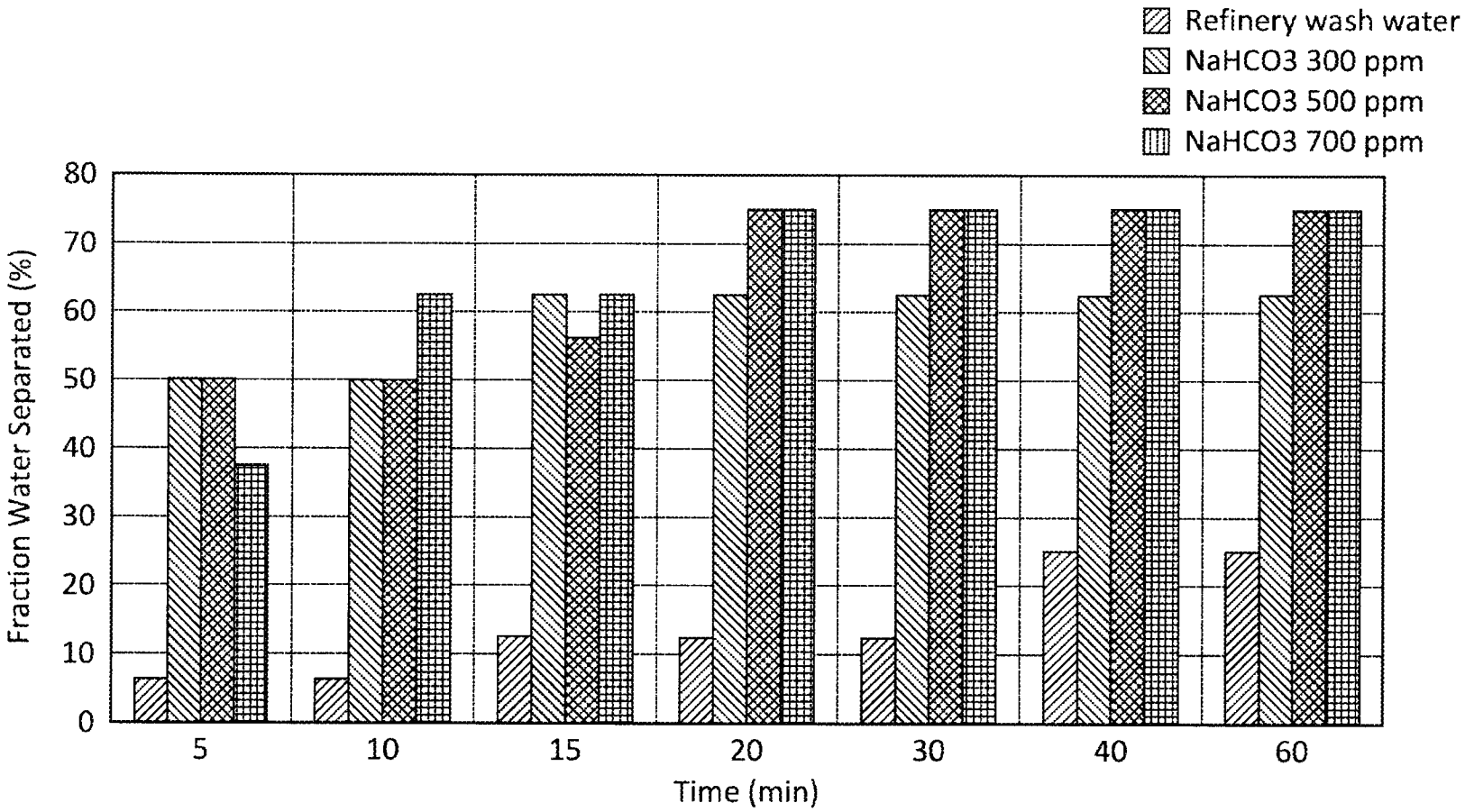
FIG. 9*a* depicts the effect of sodium bicarbonate ($NaHCO_3$) in water separation to change effluent pH of Crude B.
Figure 9B:
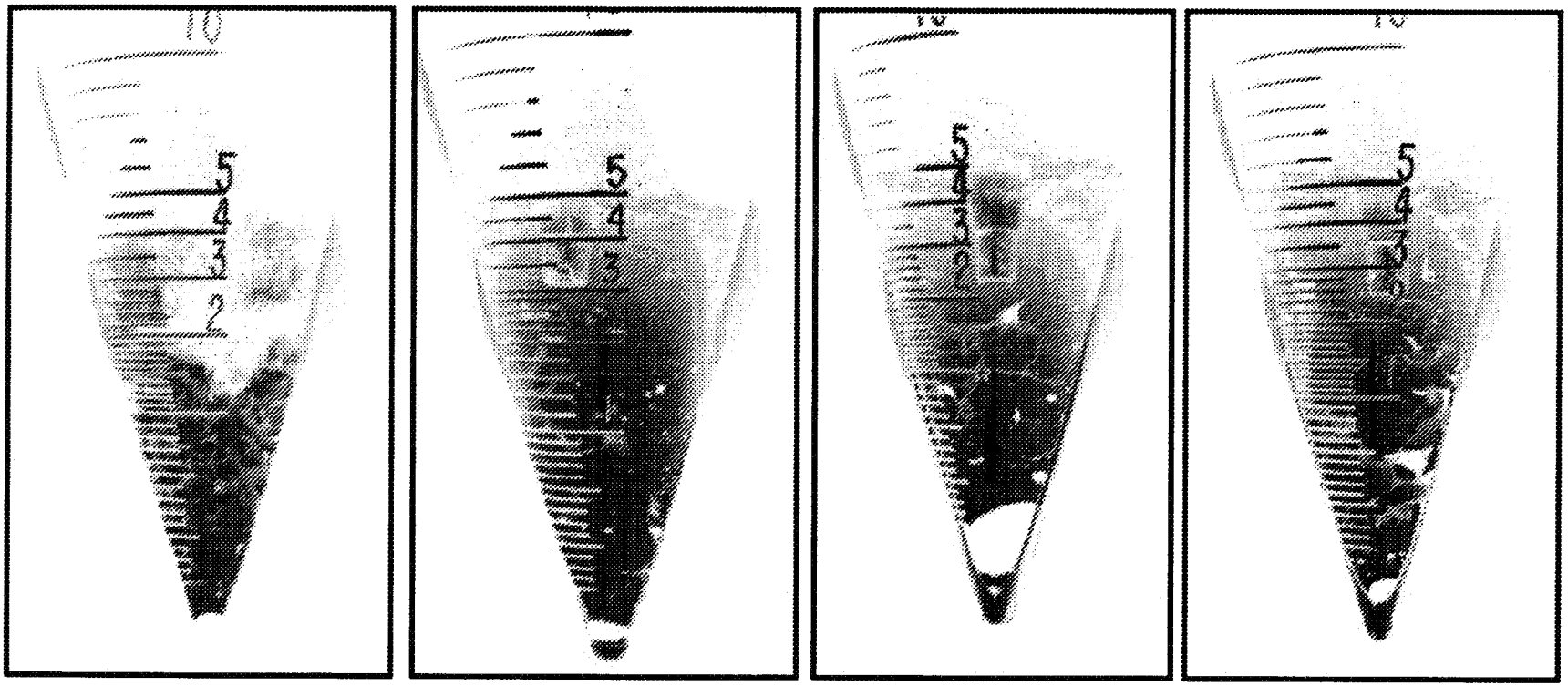
FIG. 9*b* depicts the effect of sodium bicarbonate ($NaHCO_3$) in water separation to change effluent pH of Crude B.

The use of local refinery wash water with total alkalinity of about 40 ppm shows the lab effluent pH of 4.3 with Crude B and very low water separation, as shown by FIG. 9*b*. FIG. 9*a* also shows the behavior of Crude B crude oil crude emulsion with varying water total alkalinity between 40 to 700 ppm (as $CaCO_3$ ppm) by addition of sodium bicarbonate. The higher the alkalinity in this Example, the resulting effluent pH becomes much more manageable at about 6.9 to about 7.8 and greatly improves water separation.

Further Discussion on Examples 1-4

Figure 10A:
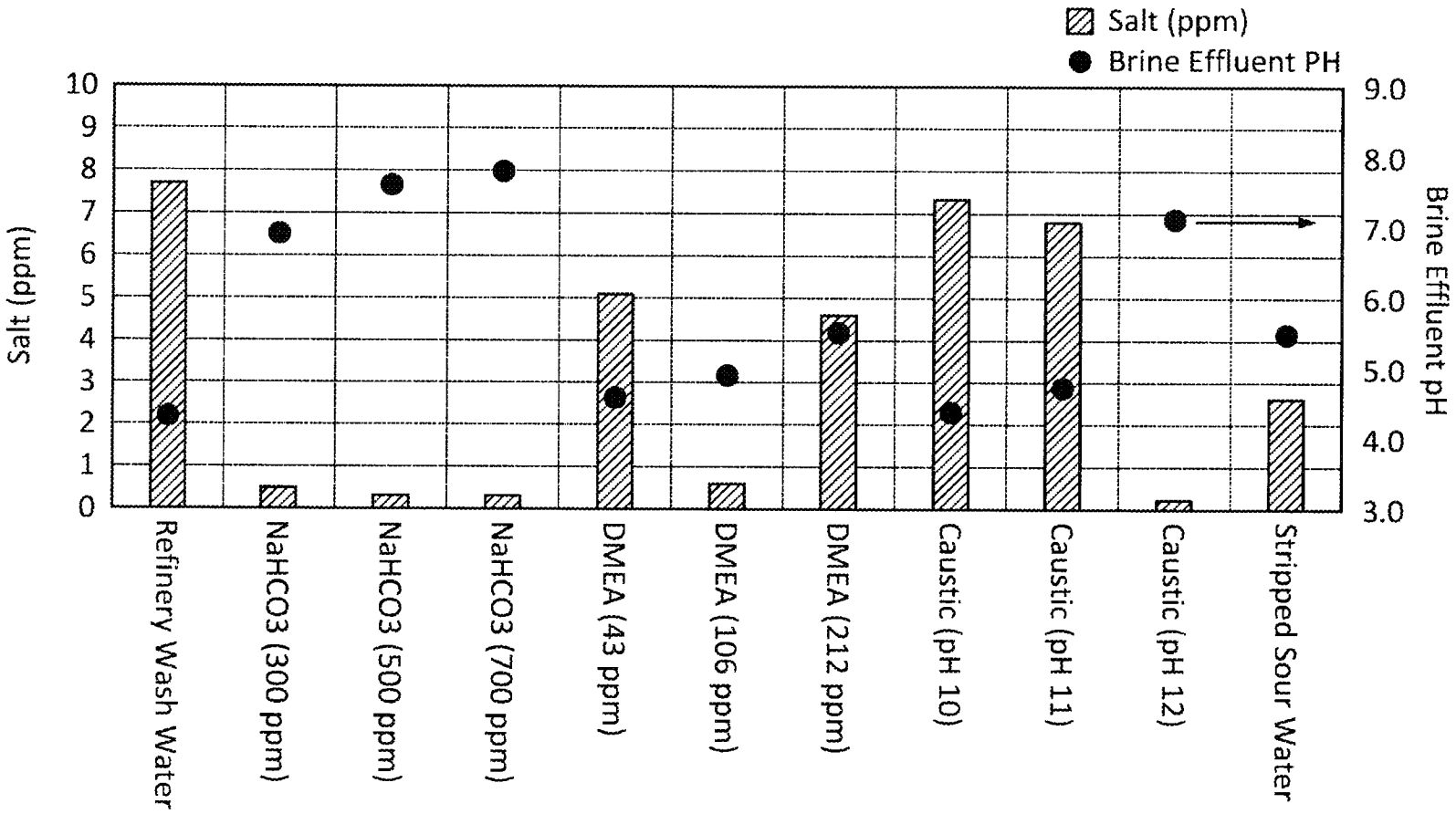
FIG. 10*a* depicts the effect of wash water modification and respective impact on residual salt content in top oil sample taken from PED testing brine pH is shown (as depicted by line in graph).

Lower residual salts in the desalted crude are expected to create fewer issues of carryover of overhead chlorides. FIG. 10*a* shows the residual salt remaining in the Crude B crude oil after undergoing treatment with different quality water sources. As expected, the cases that yield lower brine pH result in higher residual salt in the desalted crude, which will increase the risk of tower corrosion risk. Most of the residual salts in these lower pH cases are likely present in an emulsion phase. Crude B crude oil treated with sodium bicarbonate results in the lowest residual levels of salt in the desalted crude. Likewise, the desalter brine effluent pH was of an acceptable level. The alkalinity modifier, as opposed to unmodified refinery wash water, additions of caustic and amine, and stripped sour water, proves advantageous in comparison to the alternatives because it is effective at removing salts and maintains a moderate pH both in the desalter unit and in brine.

Figure 10B:
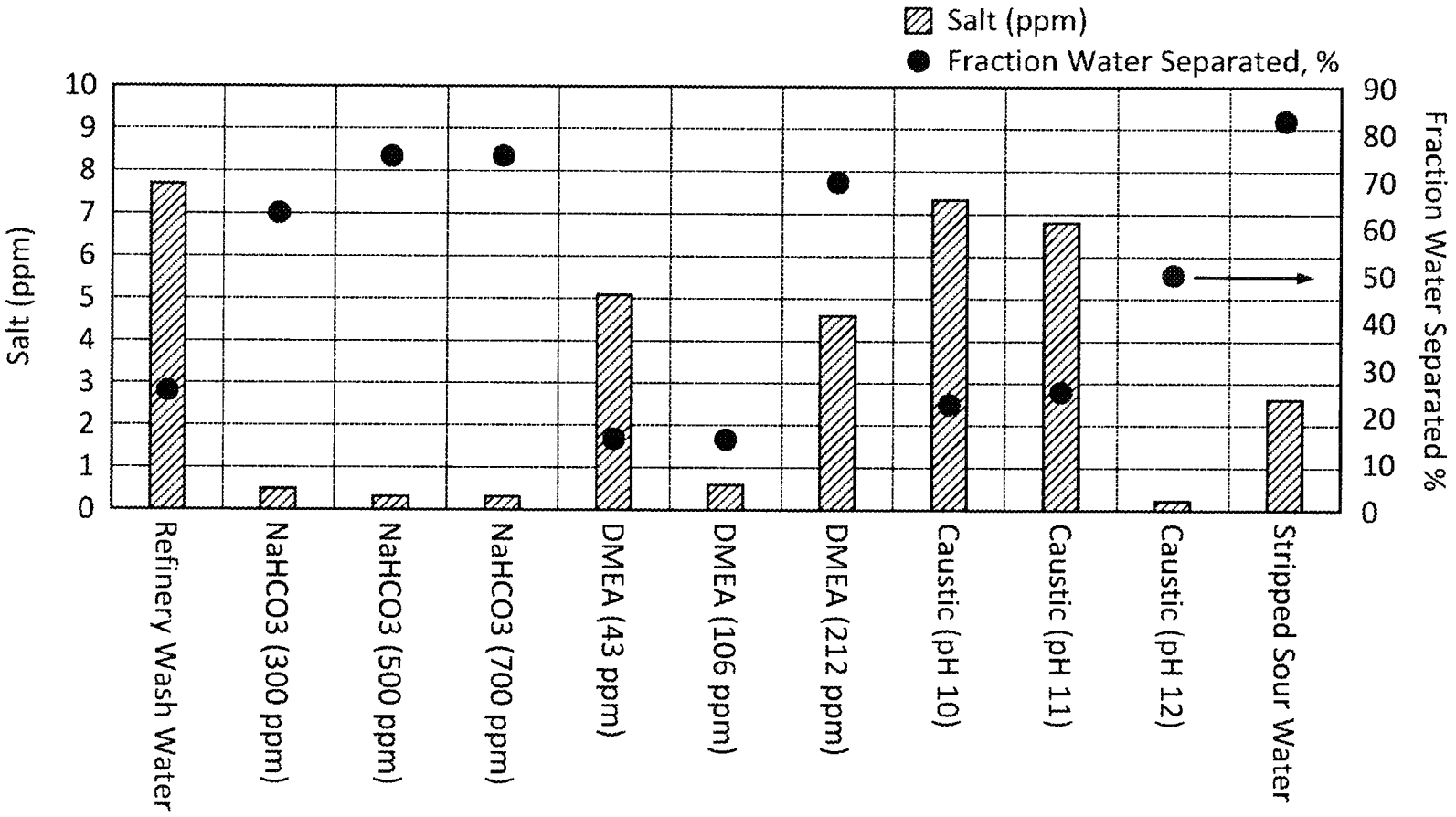
FIG. 10*b* depicts the effect of wash water modification and respective impact on residual salt content in top oil sample taken from PED testing (as depicted by bars in graph).

FIG. 10*b* shows the effect of pH control with the alkalinity modifier in affecting excess salt (in an emulsion phase) from a desalted Crude B oil sample. The figure shows that the samples treated with the alkalinity modifier between 300 to 700 ppm (as $CaCO_3$) consistently shows to lower excess salt in the desalted oil with pH controlled with the alkalinity modifier between pH 5.0 to 8.0. The Crude B oil sample emulsion made with the refinery wash water resulted in much higher levels of salt when the effluent pH is about 4.0. The desalted crude oil samples that exhibited lower effluent pH resulted in more excess salt present in the top oil phase in comparison to desalted samples where effluent pH was neutralized. Note that the cases with lower effluent pH directionally show less fraction of water separated. This is an indication of more of an emulsion presence containing excess salt that is expected to be carried over in the downstream process affecting downstream reliability.

Example 5

Crude B oil and a more typical refinery crude feed blend were used to study the effluent pH and emulsion behavior by varying the alkalinity of the water source used in the test by addition of $KHCO_3$. The $KHCO_3$ was added to a desalter wash water source for mixing with the crude oil. A concentrated high alkalinity stock solution was created by adding 0.38 grams of $KHCO_3$ into 200 mL of wash water (1900 ppm $KHCO_3$), this is equivalent to 940 $CaCO_3$ mg/L (ppm) alkalinity. The following table shows the different alkalinity targets and the associated recipes for the modified wash waters for testing.

| ID | Alkalinity Target $CaCO_3$ mg/L | Volume of Stock Solution | Volume of wash water |
|---|---|---|---|
| Blank | | 0 mL | 100 mL |
| Solution 1 | 300 mg/L | 24 mL | 76 mL |
| Solution 2 | 600 mg/L | 39 mL | 61 mL |
| Solution 3 (Stock) | 940 mg/L | No adjustment | No adjustment |

Static dehydration and emulsion resolution tests were performed using an Interav Model EDPT-228 Portable Electrostatic Dehydrator (PED). Crude oil and wash water were poured and blended using Chandler Blender cups, then put into a 90° C. water bath for 20-30 minutes to allow the mixture to equilibrate to the test temperature. Cups were removed from the bath one at a time and blended at a pre-determined blend condition. The crude and water blends were then poured into preheated PED tubes and placed in the PED heater block, which was set at 90° C. Once all the PED tubes were filled, 500 volts were applied to each tube to promote water droplet coalescence.

The table shows the two approaches used to study a Crude B crude oil and its blend with water with varying alkalinity.

| | Phase 1 | Phase 2 |
|---|---|---|
| Feed | 100% Crude B | 25% Crude B/75% Refinery feed blend |
| Temperature | 90° C. | 90° C. |
| Oil/Water Ratio | 92 mL/8 mL | 92 mL/8 mL |
| Blend Speed | 3000 rpm | 12000 rpm |
| Blend time | 8 s | 8 s |
| Emulsion breaker | None | 5 ppm |
| Water source | 300 ppm $KHCO_3$ | 300 ppm $KHCO_3$ |

Phase 1 work includes an assessment of the behavior of 100% Crude B, whereas the Phase 2 work was done on a 25% Crude B in the refinery feed blend. The water source used was varied in total alkalinity with $KHCO_3$ for both cases. Effluent pH measured after allowing cooling of water phase.

Figure 11:
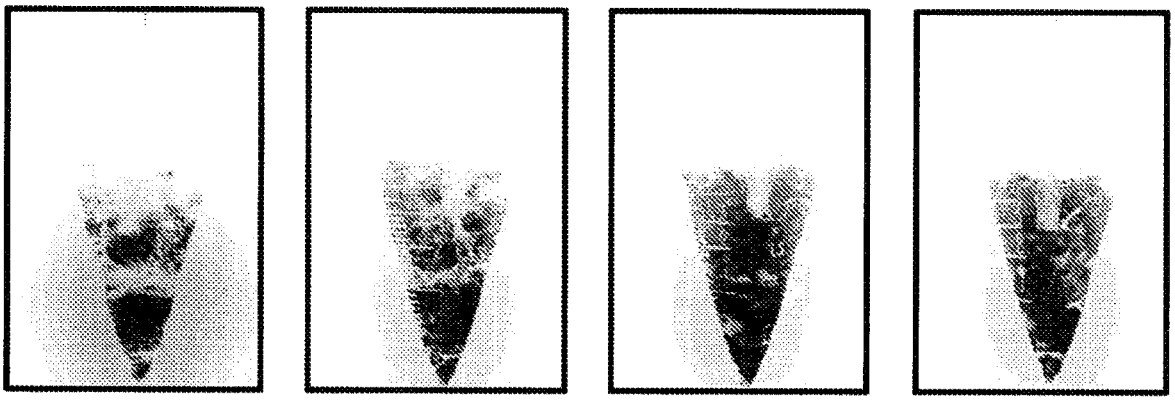
FIG. 11 depicts the effect of $KHCO_3$ on water separation and effluent pH in processing Crude B.
Figure 12:
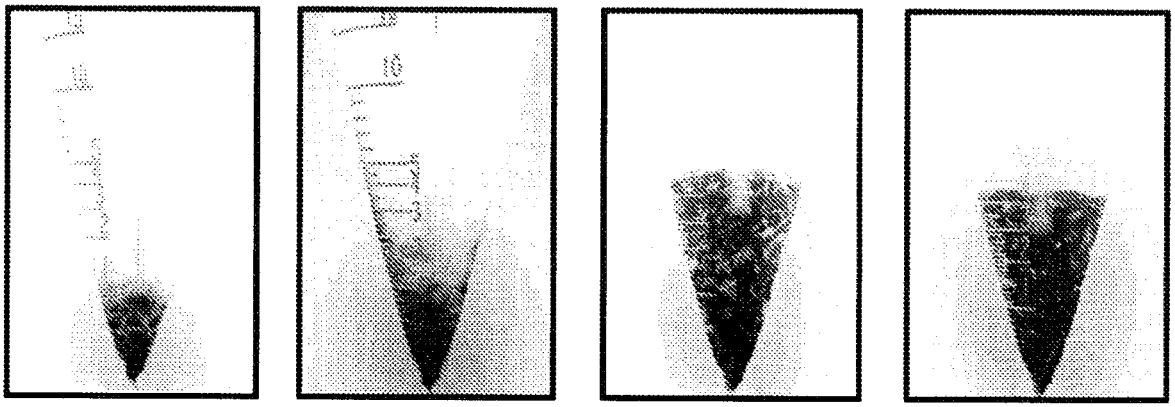
FIG. 12 depicts the effect of $KHCO_3$ on water separation and effluent pH in processing Crude B with a refinery crude mix.

FIG. 11 shows the behavior of Crude B crude oil crude emulsion with varying water total alkalinity between 300 to 950 (as $CaCO_3$ ppm) with $KHCO_3$. Without any $KHCO_3$, Crude B crude oil is expected to result in very low effluent pH. The figure shows a stable emulsion with a low pH of around 4.3. With higher total alkalinity (e.g. 300 as $CaCO_3$ ppm), the resulting effluent pH becomes much more manageable at about 6.72 to about 8.72 and greatly improves water separation. These observations are consistent with prior work done with $NaHCO_3$. There is no emulsion breaker added in this test. FIG. 12 shows the behavior of 25% Crude B blended with the refinery crude feed. These tests were done with and without an emulsion breaker. The use of the emulsion breaker shows more effective resolution of the oil and water phase. In this case, a low effluent pH 4.8-5.0 is still seen with 25% Crude B. The addition of $KHCO_3$ (300 as $CaCO_3$ ppm) continues to neutralize the effluent pH effectively.

FIG. 11 shows corrosion control with effluent pH being maintained consistently between pH 5.0 to 8.0 with the addition of an $KHCO_3$ alkalinity modifier ranging between 300 to 950 ppm (as $CaCO_3$ ppm). Strong acid (e.g. hydrochloric acid) corrosion can result from low pH—carbon steel, in particular, can have high annual corrosion rates ion a low pH environment. The addition of an alkalinity modifier that the effluent pH can be consistently neutralized to pH 5.0 to 8.0 when processing acidic crude oils.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A system comprising:

a desalting vessel;

a pretreated hydrocarbon feedstock supply operable to flow the pretreated hydrocarbon feedstock into the desalting vessel, wherein the pretreated hydrocarbon feedstock supply comprises at least hydrocarbon feedstock and dissolved salts;

a wash water supply operable to flow the wash water into the desalting vessel, wherein the wash water supply comprises at least water;

an alkalinity modifier supply operable to flow the alkaline modifier into the desalting vessel, wherein the alkalinity modifier supply comprises at least one alkalinity modifier or solutions thereof;

a desalted crude outlet operable to flow desalted crude oil out of the desalting vessel, wherein the desalted crude oil comprises hydrocarbon feedstock with less dissolved salts by weight than the hydrocarbon feedstock in the pretreated hydrocarbon feedstock supply; and a wash water brine outlet operable to flow brine out of the desalting vessel, wherein the brine comprises water with more dissolved salts by weight than the water in the wash water supply, wherein the system is operable to maintain the brine at a pH in the range from 5.5 to 6.5, wherein the alkalinity modifier supply is selected from the group consisting of sodium bicarbonate, sodium carbonate, potassium bicarbonate, potassium carbonate, ammonium bicarbonate, and ammonium carbonate.

2. The system of claim 1, wherein the alkalinity modification supply is in fluid communication with the wash water supply prior to the alkalinity modification supply and wash water supply flowing into the desalting vessel.

3. The system of claim 1, wherein the alkalinity modification supply is in fluid communication with the pretreated hydrocarbon feedstock supply prior to the alkalinity modification supply and pretreated hydrocarbon feedstock supply flowing into the desalting vessel.

4. The system of claim 1, wherein the pretreated hydrocarbon feedstock supply, wash water supply, and alkalinity modification supply separately flow into the desalting vessel.

5. The system of claim 1, wherein within the desalting vessel, the contents of the pretreated hydrocarbon feedstock supply, wash water supply, and alkalinity modifier supply mix and dissolved salts from the pretreated hydrocarbon feedstock supply are transferred into water from the wash water supply.

6. The system of claim 1, wherein the alkalinity modifier supply and the wash water supply mix prior to or inside of the desalting vessel and the resulting concentration of the alkalinity modifier in the wash water following the mixture is between about 100 ppm and 2000 ppm by weight.

7. The system of claim 1, wherein the alkalinity modifier supply and the wash water supply mix prior to or inside of the desalting vessel and the resulting concentration of the alkalinity modifier in the wash water following the mixture is between about 300 ppm and 1200 ppm by weight.

8. The system of claim 1, wherein the contents of the desalted crude outlet from the desalting vessel have a salt composition of not more than 6 ppm by weight.

9. The system of claim 1, wherein the hydrocarbon feedstock is selected from the group consisting of: crude petroleum oil, triglyceride-based feeds, seed oils, tire oils, slop oil, biomass oils, nut oils, and combinations thereof.

* * * * *